US005931351A

United States Patent [19]

Renualt et al.

[11] Patent Number: 5,931,351

[45] Date of Patent: Aug. 3, 1999

[54] CLOSING CAP FOR A CONTAINER WITH A NECK

[75] Inventors: Philippe Renualt, Chaville; David Balayn, Paris, both of France

[73] Assignee: L'Oreal, Paris, France

[21] Appl. No.: 08/921,610

[22] Filed: Sep. 2, 1997

[30] Foreign Application Priority Data

Sep. 12, 1996 [FR] France ..... 96 11142

[51] Int. Cl.[6] ..... B65D 47/04

[52] U.S. Cl. ..... 222/182; 222/558; 215/286; 220/322

[58] Field of Search ..... 222/182, 558; 215/286, 290, 293; 220/322, 314

[56] References Cited

U.S. PATENT DOCUMENTS

| | | | |
|---|---|---|---|
| 229,638 | 7/1880 | Reilay | 215/286 |
| 675,986 | 6/1901 | Sutton | 215/286 |
| 705,182 | 7/1902 | Wiese | 215/286 X |
| 708,648 | 9/1902 | Karrmann | 215/286 |
| 1,417,975 | 5/1922 | Crane . | |
| 2,149,795 | 3/1939 | Skoblin | 222/558 X |
| 4,676,407 | 6/1987 | Rideot | 222/182 |

FOREIGN PATENT DOCUMENTS

| | | | |
|---|---|---|---|
| 955029 | 1/1950 | France | 215/290 |
| 1010083 | 6/1952 | France . | |
| 1439971 | 12/1966 | France . | |
| 850 984 | 9/1952 | Germany . | |

*Primary Examiner*—Kenneth Bomberg
*Attorney, Agent, or Firm*—Oblon, Spivak, McClelland, Maier & Neustadt, P.C.

[57] ABSTRACT

A closing cap for a bottle (2) includes a collar (4) intended to be mounted on the neck (20) of the bottle; a closing hood (60) provided with a top (76) and with a cylindrical side wall (64) capable of being positioned round the collar (4); a rigid shackle (8) having two ends **(12*a*, 14*a*) connected by a central portion (10), the ends being mounted on the collar for pivoting round an axis (B) so that, by pivoting, the central portion of the shackle (8) comes to bear against the top of the hood; and an elastic part (72) capable of permitting an axial displacement of the top of the hood relative to the shackle (8) and of ensuring the permanent bearing of the top (76) against the shackle (8). The elastic part may be by at least one zone (72) of the elastically deformable hood unitary with the hood (60)**.

18 Claims, 4 Drawing Sheets

FIG.2a
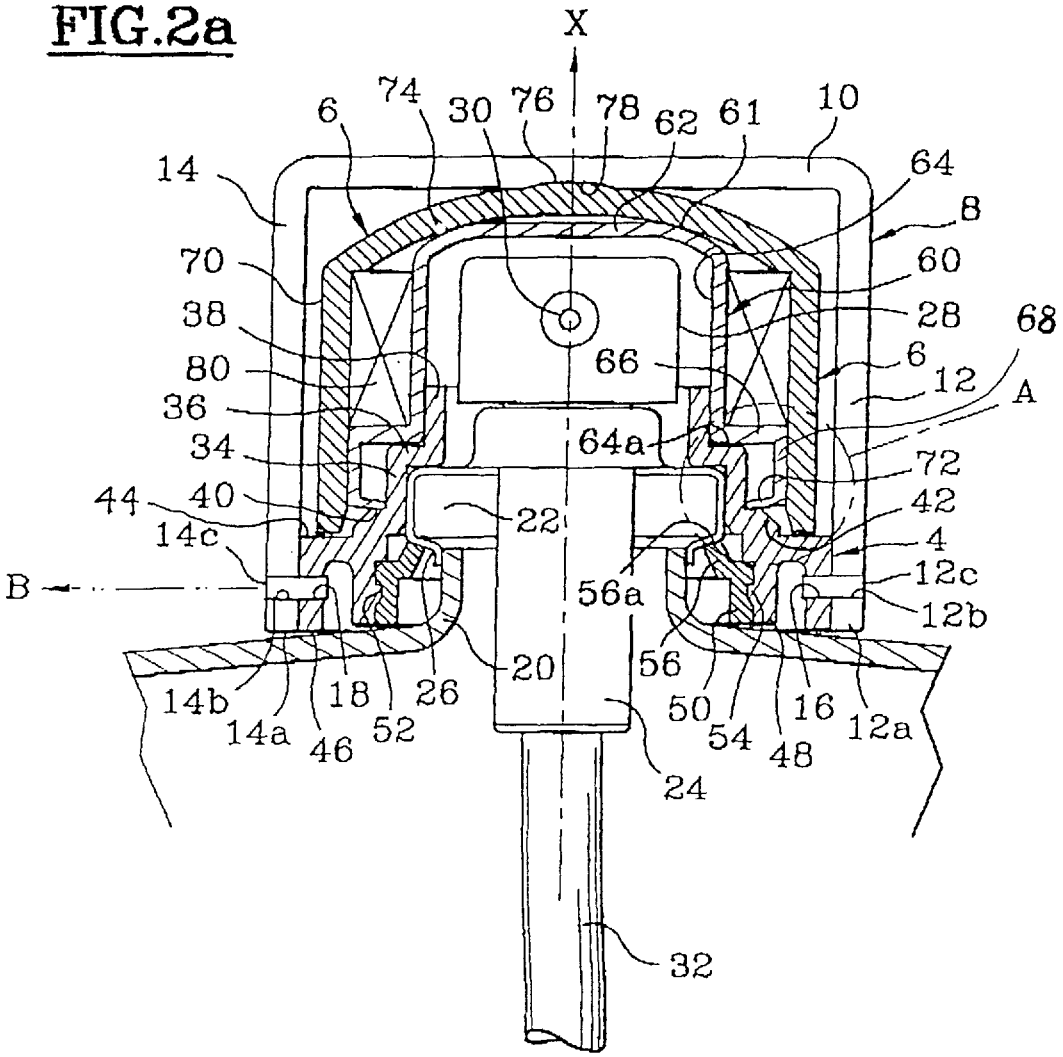
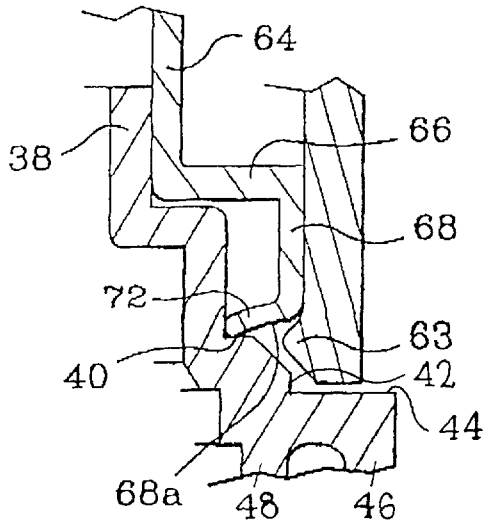
FIG.2b

CLOSING CAP FOR A CONTAINER WITH A NECK

BACKGROUND OF THE INVENTION

1. Field of the Invention

The present invention relates to a closing cap for a container forming a reservoir for a product, in particular a liquid product. More particularly, the cap is provided with a closing hood and includes a system for wedging on the hood. The invention also relates to a container provided with this cap. Generally, this container is a bottle with a neck, in particular a perfume bottle made of glass.

2. Description of the Related Art

From FR-A 0 955 029 there is known a container with a lid provided with a system for wedging on the lid. The wedging system includes a handle (or shackle) mounted for pivoting on a side wall of the container and cooperating, in the vertical position of the shackle, with a locking knob mounted for rotation at the center of the lid. This knob ensures that the shackle is held in position and that the lid is locked on the container. A rubber gasket disposed on the lid ensures sealing of the container.

Moreover, from FR-A-1 541 166 there is known a system for stoppering a bottle, including a pivoting shackle provided with a stopper capable of obturating the neck of the bottle. To ensure that the stopper bears elastically on the neck, the shackle is mounted for sliding along the axis of the bottle, elastic means being provided for elastically biasing the shackle towards the neck of the bottle. However, this stoppering system has the drawback of being formed by parts that are complicated to make, and which require complex equipment for their assembly. Moreover, the elastic means are visible from the outside and give this system an unpleasing appearance.

SUMMARY OF THE INVENTION

It is an object of the present invention to provide a system of the above mentioned kind for closing a container, in particular a perfume bottle, comprising a closing cap provided with a hood for protection or closure, and a pivoting shackle for wedging the hood on the bottle.

The invention is based on the recognition that when a cap is made of a hood and a shackle made of a galvanized plastic material, one obtains very rigid, inelastic parts whose tolerances are such that in many cases it is not possible to mount the shackle above the cap. When the cap is undersized the shackle is not in contact with the hood and cannot ensure that it is wedged on; when the hood is oversized, it is not possible to cause the shackle to pivot into a vertical position and to position it above the hood. Such a design cannot be exploited industrially.

It is therefore a further object of the invention to provide a stoppering system allowing rigid parts to be used, without the assembly or proper functioning of the cap being impeded by the tolerances of its parts.

Thus, according to a first aspect, the invention provides a closing cap for a bottle with a neck comprising a collar having a first axis and intended to be mounted on the neck of the bottle, a closing hood provided with a top and with a cylindrical side wall capable of being positioned around the collar, a rigid shackle having two ends connected by a central portion, the ends being mounted on the collar for pivoting around a second axis perpendicular to the first axis so that, by pivoting, the central portion of the shackle comes to bear against the top of the hood, and means capable of causing the top to bear against the shackle. According to the invention, the means capable of causing the top to bear against the shackle include elastic means permitting an axial displacement of the top of the hood relative to the shackle.

Advantageously, the elastic means are constituted by at least one zone of the hood that is elastically deformable in axial compression, this zone formed unitary with the hood.

The bottle may contain, for example, a cosmetic cream or a perfume. Thus, according to another aspect, the invention provides a perfume bottle, in particular one with a neck upon which the cap is mounted.

Advantageously, this bottle is made of glass since, in contrast to plastic materials, it does not change the quality of the perfumes and is not attacked by the perfume. Moreover, assembly of the cap on a glass bottle does not require a rubber seal. This is advantageous since rubber or similar materials are not generally compatible with the composition of the perfume.

According to a preferred embodiment of the invention the hood is made of a material, such as polypropylene or polyoxymethylene, having a shape memory in deformation. Because of this, it is possible to integrate the elastic compression means in the hood so that it can be molded as one piece with the elastic means. According to a first possibility, these elastic means are carried by a free end of the side wall of the hood, this free end being formed, for example, by the base of the hood. In this case, the elastic means may take the form of at least one flexible tongue bearing on a radially projecting portion carried by the collar. Advantageously, this portion is situated between the articulations and the free end of the collar on the opposite side to the bottle. In a particular embodiment, the projecting portion is annular. In this case, a plurality of flexible tongues, six or eight for example, are regularly distributed over the base of the hood.

Advantageously the hood is surrounded by a cover cap over its side wall and its top. Advantageously this cover cap constitutes a decorative element, in which case the collar, the shackle and the cover cap may be made either of metal or of plastic covered by a metallic layer. Preferably the collar, the shackle and the cover cap are made of an electroplatable plastic material such as, for example, ABS (a copolymer of acrylonitrile-butadiene-styrene) or Polypro Codix® (polypropylene enriched with charges of barium carbonate) marketed by the R.P.T. Company. The collar, shackle and the cover cap may be covered by one or more metallic layers. Because of the electroplating of these parts they become very rigid and compensation for variations of the dimensions of these parts cannot be undertaken by relying on the elasticity of the material thereof.

Advantageously, the shackle takes the form of a "U" formed with a central portion and two side portions, the side portions forming, for example, an angle of approximately 90° with the central portion. In this case, the distance between the free ends of the side portions substantially corresponds to the width of the collar. The articulations permitting the pivoting of the shackle on the collar may be constituted by two pins radially projecting towards the outside relative to the collar, each cooperating with a complementary bore cut in each free end of the side arms. The height of the shackle is dimensioned in such a way that, in the vertical position of the shackle, the central portion can come to bear against the top of the hood.

Due to the presence of the elastic means, the hood is elastically displaceable along the axis of the cap. Thus the dimensional variations of the shackle and of the hood (and if applicable, of its cover cap) can be compensated, so that in all cases, the hood (and its cover cap) may be suitably kept in place on the collar by the shackle. To immobilize the shackle in its vertical position, its central portion may be provided with a sunk portion capable of receiving a boss formed in the center of the cover. If applicable, ballast can be inserted between the hood and the cover cap.

In a second embodiment, the elastic means comprise an annular zone elastically deformable in the axial direction of the cap, a portion of this zone being capable of coming into contact with the shackle. The portion of the zone coming into contact with the shackle when the shackle is in its vertical position may, for example, be constituted by a stub. In order to immobilize the shackle in its vertical position, the central portion of the shackle may be provided with a sunk portion capable of receiving the stub. When a cover cap surrounding the hood is provided, this cover cap is provided with a central opening traversed by the stub which can thus come into contact with the shackle.

To ensure fixing of the collar on the neck of the bottle, the neck may be provided with a peripheral bead situated at the free end of the neck. In this case, the collar may be provided with catch engagement tabs to ensure that the cap is non-detachable. These catch engagement tabs may form part of the collar, or be on a separate catch engagement ring capable of being catch engaged on the collar. These tabs are radially elastically deformable tabs extending towards the axis of the cap at an angle of inclination of approximately 30°. Thus, when the collar is positioned on the neck of the bottle, the peripheral bead causes the tabs to bend outwardly and be finally positioned in the angle formed between the neck and the bead.

When the neck of the bottle does not have a dispensing element, the hood may internally carry a substantially cylindrical sealing skirt intended to be positioned, in the closed position of the cap, against the internal side of the neck.

When the bottle is to have a dispensing element, the dispensing element is inserted into the neck of the bottle where it may be set in by means of a metallic flange. The dispensing element may be a pump or a valve actuable by means of a push button of a spraying nozzle.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2*a* shows in axial section a first embodiment of a closing cap of the invention, for a bottle provided with a dispensing element;

FIG. 2*b* shows an enlarged partial axial section at the encircled portion of FIG. 2*a;*

DETAILED DESCRIPTION OF THE PREFERRED EMBODIMENTS

Figure 1:
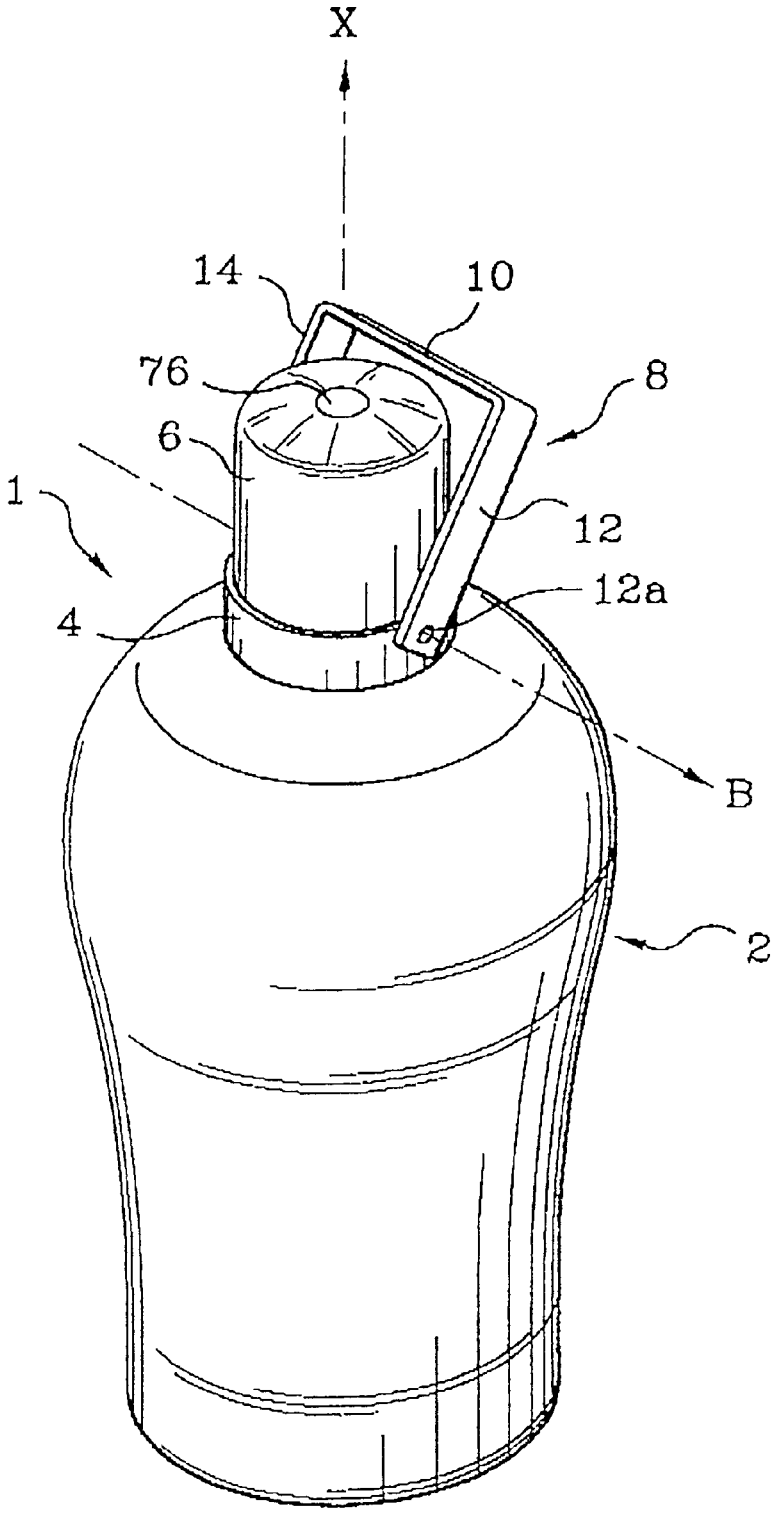
FIG. 1 is a perspective view of a perfume bottle and closing cap in accordance with the invention.

FIGS. 1, 2*a* and 2*b* show a closing cap 1 mounted on a perfume bottle 2. The cap 1 has the shape of a body of revolution around an axis X. This cap 1 has a cylindrical collar 4 surmounted by a hood and a cover cap 6 and a pivoting shackle 8. The shackle 8 has a central portion 10 joined at an angle of approximately 90° to two substantially parallel side arms 12, 14 having free ends 12*a,* 14*a*. In the vicinity of the free ends 12*a,* 14*a,* each arm 12, 14 is provided with a bore 12*b,* 14*b* in which fits a pin 12*c,* 14*c*. Each pin is fixed in an appropriate bore 16, 18 of the collar 4, as will be set out in detail below. The bores 16, 18 are diametrically opposed on the collar and aligned along an axis B orientated perpendicularly to the axis X.

As may be seen in FIG. 2*a,* the bottle 2 has a cylindrical neck 20 provided with a collar 22 projecting radially towards the outside. Inside this neck, a dispensing element is fixed by crimping, which here is a pump 24 fixed to the neck by means of a metal flange 26. For the actuation of the pump 24, there is provided a push button 28 having a spraying nozzle 30, allowing a dose of perfume to be dispensed in the form of fine droplets. Inside the bottle, the pump 24 is joined to a dip tube 32 communicating with the perfume composition to be dispensed.

The collar has a generally cylindrical shape. It has a cylindrical sleeve 34 surrounding the fixing flange 26 of the pump. On the opposite side to the bottle, the sleeve 34 has a first annular shoulder 36 extended as a cylindrical tube 38 with a smaller diameter than that of the sleeve 34. On the side facing towards the bottle, the sleeve 34 has a second shoulder 40 joined to an annular projection 42 with a larger diameter than that of the sleeve 34. The projection 42 is joined to a disk-shaped circular plate 44, whose diameter is larger than that of the projection 42. On the opposite side to the projection 42, the plate has a first cylindrical skirt 46 and a second cylindrical skirt 48. The first skirt 46 has an external diameter substantially equal to the distance between the ends 12*a,* 14*a* of the side arms of the shackle 10 and bears against the body of the bottle 2. This skirt 46 is provided with the above mentioned bores 16, 18 in which the pins 12*c,* 14*c* are fixed. The second skirt 48, with a smaller diameter than that of the first, extends in the direction towards the bottle and has substantially the same external diameter as the projection 42, but a diameter larger than that of the collar 22 of the neck of the bottle. In this way, the collar 4 can be positioned on the neck of the bottle such that the shoulder 36 bears against the neck.

To mount the collar 4 on the neck 20 of the bottle in a non-detachable manner, a ring 50 is joined to the internal side of the second skirt 48. The fixing of the ring 50 on the collar is provided by a system comprising an annular bead 52 and an annular groove 54. The end of the ring 50 remote from the bottle is provided with a plurality of fastening tabs 56 regularly distributed over the whole circumference of the ring 50 and extending towards the axis X at an angle of inclination of approximately 30°. These tabs 50 are flexible, so that after the collar has been mounted on the neck of the bottle, the free end 56*a* of each tab 50 bears against a bent-back edge of the flange 26.

A hood 60 capable of surrounding the push button 28 is fixed on the collar 4. The hood 60 has a dome-shaped circular top 62 joined at its circumference to a cylindrical wall 64. The edge 64*a* at the opposite side to the top of the side wall is bent radially outwardly and thus forms a shoulder 66. The internal diameter of the side wall 64 corresponds substantially to the external diameter of the tube 38 of the collar. The circumference of the shoulder is joined to a cylindrical portion 68 with a larger diameter than that of the side wall 64. In this embodiment, the cylindrical portion 68 has a free edge 68*a* which carries a plurality of elastic tongues 72 extending towards the axis X. These elastic tongues 72 are inclined in the direction towards the bottle and bear against the second shoulder 40 of the collar, so that a bearing force along axis X exerted on the top 62 of the hood 60 causes the tongues 72 to bend and the cover cap to be axially displaced.

The hood 60 is surrounded by a calotte-shaped cover cap 6 with a cylindrical side wall 70. The hood is held in the cover cap 6 in compression between an upper contact zone 61 and a lower fastening ring 63. This cover cap 6 has a dome 74 carrying a boss 76 at its center, capable of being accommodated in a sunk portion 78 of the central portion of the shackle 8 when the shackle is placed into its vertical position. In an annular space between the wall 64 of the hood and the side wall 70 of the cover cap 6 there is provided a ballast 80 of an annular shape made, for example, of metal, for example of zamac.

The ring 50 and the hood 60 are made of a material, such as polypropylene or polyoxymethylene, having a shape memory in deformation. The collar 4, shackle 8, push button 28 and the cover cap 6 are made of an electroplatable plastic material covered by a metallic layer. Preferably, these parts are made of ABS (a copolymer of acrylonitrile-butadiene-styrene) or of Polypro Codix®. The metallic layer consists, for example, of a succession of layers of nickel, copper, nickel and chromium.

By the features described above, it is possible to compensate for dimensional variations of the cover cap and of the shackle so that in spite of these variations, the hood (and the cover cap) can be wedged on by the shackle.

Figure 3:
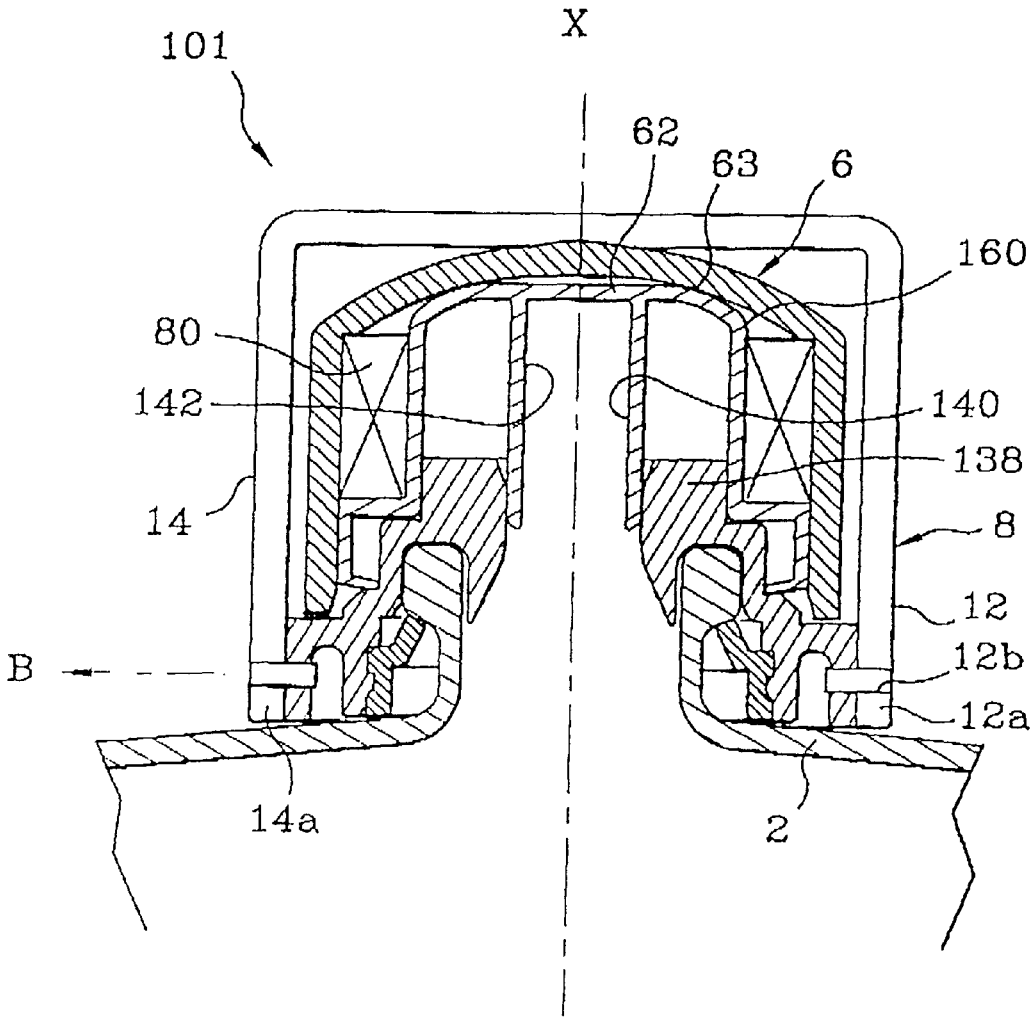
FIG. 3 shows an axial section of a second of embodiment of closing cap according to the invention.

FIG. 3 shows a second embodiment of cap 101 according to the invention, mounted on a bottle 2. This bottle is distinguished from that of FIGS. 2*a,* and 2*b* by the absence of the dispensing element. In FIG. 3, parts which are identical with those of FIGS. 2*a* and 2*b* bear the same reference numerals. Their description will not be repeated.

The end 138 of the collar 4 on the opposite side to the bottle 2 is formed as a dispensing opening 140. This opening 140 is obturated by a cylindrical stem 142 frictionally entering the stem. The stem 142 is joined to the internal side of the top 62 of the hood 160.

In the embodiment of FIGS. 2*a* and 3, the hood 60 (or 160) and the cover cap 6 may be made by a duplex injection molding of the hood of polypropylene and of the cover cap of Polypro Codix® whose density is, for example, 1.4 g/cm$^3$. In this embodiment, the unit obtained by the duplex injection molding is immersed in plating baths, only the zones of Polypro Codix® receiving a metallic layer. This embodiment has the advantage that there is no need for mounting the hood in the cover cap.

Figure 4:
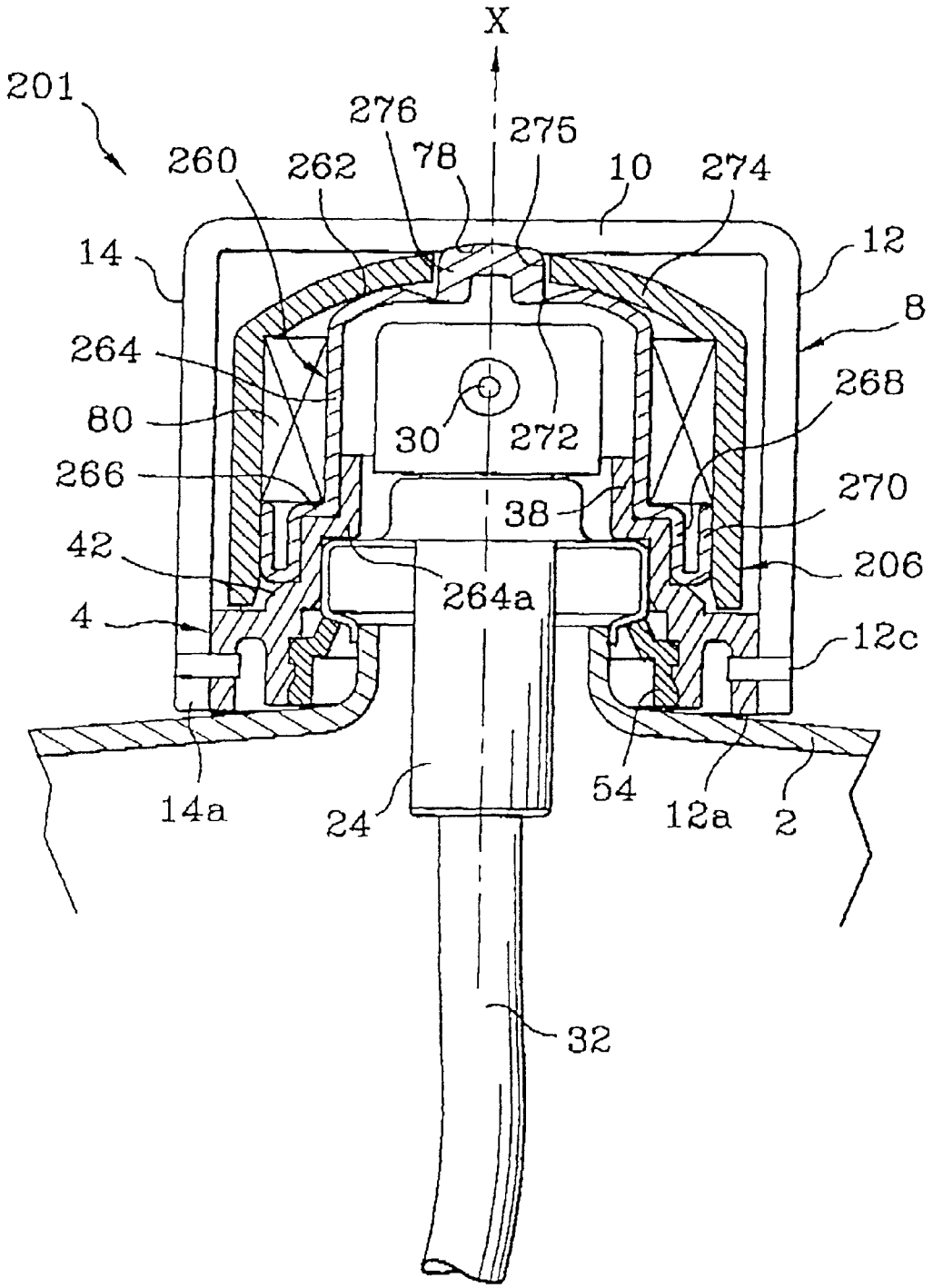
FIG. 4 shows an axial section of a third embodiment of a closing cap according to the invention, for a bottle provided with a dispensing element.

FIG. 4 shows a third embodiment of cap 101 according to the invention. This bottle is distinguished from that of FIGS. 2*a* and 2*b* by a different structure of the hood 260 and of the cover cap 206. Moreover, the hood 260 does not have any tongues. In FIG. 4, parts identical with those of FIGS. 2*a* and 2*b* bear the same reference numerals. Their description will not be repeated.

The hood 260 has a dome-shaped circular top 262 joined at its circumference to a cylindrical side wall 264. The edge 264*a* on the opposite side to the top of the side wall 264 is bent radially outwardly and thus forms a shoulder 266. The internal diameter of the side wall 264 corresponds substantially to the external diameter of the tube 36 of the collar 4. The circumference of the shoulder 266 is joined to a cylindrical portion 268 with a diameter larger than that of the side wall 264. The cylindrical portion 268 is joined to a cylindrical ring 270 forming a structure with a U-shaped cross-section together with the portion 268. The ring 270 serves as a support for a cover cap 206.

The top 262 of the hood 260 includes a zone 272, formed by a film of material, elastically deformable in the direction of the axis X. The center of the zone 272 carries a stub 276 capable of being accommodated in the sunk portion 78 of the central portion 10 of the shackle 8 when the shackle is placed into the vertical position.

The hood 260 is surrounded by the cover cap 206 which rests on the top 262 of the hood 260 and tightly holds the ring 270. The cover cap has a dome 274 provided with a circular central opening 275. This opening 275 is traversed by the stub 276. A bearing force exerted on the stub 276 along axis X produces an elastic deformation of the zone 272. This elastic deformation ensures the tight elastic hold of the hood 260 against the shackle 8 when the shackle is positioned in its vertical position. When the shackle is placed into its vertical position on the top of the cover cap, the stub 276 which is carried by the hood and passes through the cover cap is subjected to an axial force. This axial force produces an elastic deformation of the zone 272, thus producing the elastic tightening of the hood and of the shackle. By means of this disposition, it is possible to compensate for the variations in the dimensions of the shackle and the cover cap.

Obviously, numerous modifications and variations of the present invention are possible in light of the above teachings. It is therefore to be understood that the invention may be practiced otherwise than as specifically described herein.

We claim:

1. A closing cap for a bottle with a neck, comprising:

a collar having a first axis and intended to be mounted on the neck of the bottle;

a closing hood provided with a top and with a cylindrical side wall capable of being positioned around the collar;

a rigid shackle having two ends connected by a central portion, the ends being mounted on the collar for pivoting around a second axis perpendicular to the first axis so that the central portion of the shackle can come to bear against the top of the hood; and means for elastically permitting an axial displacement of the top of the hood relative to the shackle when the top of the hood bears against the shackle.

2. The cap according to claim 1, wherein the elastic means includes at least one elastically deformable zone of the hood.

3. The cap according to claim 1, wherein the shackle has the form of a "U" including a central portion and two side portions, the side portions forming an angle of approximately 90° with the central portion.

4. The cap according to claim 1, wherein the hood is made of polypropylene or polyoxymethylene.

5. The cap according to claim 1, including a cover cap situated between the hood and the shackle when the shackle bears on the top.

6. The cap according to claim 5, wherein the cover cap is made of a rigid plastic material.

7. The cap according to claim 5, wherein the cover cap is made of an electroplatable plastic material.

8. The cap according to claim 1, wherein the collar is made of an electroplatable plastic material.

9. The cap according to claim 1, wherein the shackle is made of an electroplatable plastic material.

10. The cap according to claim 7, wherein the electroplatable plastic material is chosen from ABS (a copolymer of acrylonitrile-butadiene-styrene) and polypropylene enriched with charges of barium carbonate.

11. The cap according to claim 7, wherein the electroplatable plastic material is covered by a metallic external surface.

12. The cap according to claim 1, wherein the elastic means include a zone of the top of the hood which is elastically deformable in the axial direction, a portion of this zone being capable of bearing against the shackle.

13. The cap according to claim 12, wherein the cover cap has a central opening through which a stub carried by the elastically deformable zone can come in contact with the shackle.

14. The cap according to claim 1, wherein the elastic means include at least one axially elastically deformable tongue situated at the base of the hood, said tongue bearing against a portion of the collar.

15. The cap according to claim 1, wherein the ends of the shackle are connected to the collar by two diametrically opposed articulations.

16. The cap according to claim 15, wherein the articulations comprise pins.

17. A perfume bottle having a neck carrying a cap comprising:

a collar having a first axis and intended to be mounted on the neck of the bottle;

a closing hood provided with a top and with a cylindrical side wall capable of being positioned around the collar;

a rigid shackle having two ends connected by a central portion, the ends being mounted on the collar for pivoting around a second axis perpendicular to the first axis so that the central portion of the shackle can come to bear against the top of the hood; and means for elastically permitting an axial displacement of the top of the hood relative to the shackle when the top of the hood bears against the shackle.

18. The perfume bottle according to claim 17, wherein neck carries a dispensing element provided with a spraying nozzle.

* * * * *